US011107598B2

(12) United States Patent
Choquette

(10) Patent No.: US 11,107,598 B2
(45) **Date of Patent: *Aug. 31, 2021**

(54) ANTI-SCATTER COLLIMATOR FOR RADIATION IMAGING MODALITIES

(71) Applicant: Analogic Corporation, Peabody, MA (US)

(72) Inventor: Martin Choquette, Peabody, MA (US)

(73) Assignee: Analogic Corporation, Peabody, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/612,355

(22) PCT Filed: May 11, 2017

(86) PCT No.: PCT/US2017/032057

§ 371 (c)(1),
(2) Date: Nov. 8, 2019

(87) PCT Pub. No.: WO2018/208300

PCT Pub. Date: Nov. 15, 2018

(65) Prior Publication Data

US 2020/0234839 A1 Jul. 23, 2020

(51) Int. Cl.
*G21K 1/02* (2006.01)

(52) U.S. Cl.
CPC ..... *G21K 1/025* (2013.01)

(58) Field of Classification Search
CPC ..... G21K 1/025
USPC ..... 378/154
See application file for complete search history.

(56) References Cited

U.S. PATENT DOCUMENTS

2007/0064878 A1* 3/2007 Heismann ..... G21K 1/025 378/154
2007/0258566 A1* 11/2007 Eckenbach ..... G21K 1/025 378/154
2011/0129069 A1* 6/2011 Freund ..... G21K 1/025 378/147
2012/0087462 A1* 4/2012 Ikhlef ..... A61B 6/4233 378/4
2012/0132834 A1* 5/2012 Freund ..... G21K 1/025 250/505.1

(Continued)

*Primary Examiner* — Hoon K Song
(74) *Attorney, Agent, or Firm* — TraskBritt

(57) ABSTRACT

Among other things, an anti-scatter collimator (200) includes a first anti-scatter structure (302) defining a retaining member (432). The retaining member includes a first protruding member having a top surface defining a first plane, and a second protruding member having a second top surface defining a second plane. The second protruding member is spaced apart from the first protruding member to define a groove (434). The retaining member includes a support member extending between the first protruding member and the second protruding member. The support member defines a bottom surface of the groove. The bottom surface of the support member is spaced a distance apart from the first plane and the second plane. A second anti-scatter structure (303) includes a septum disposed within the groove. The first protruding member, the second protruding member, and the support member maintain a position of the septum relative to the first anti-scatter structure.

20 Claims, 11 Drawing Sheets

(56) References Cited

U.S. PATENT DOCUMENTS

| | | | | |
|---|---|---|---|---|
| 2014/0362978 | A9* | 12/2014 | Kurochi | G21K 1/025 378/147 |
| 2020/0046306 | A1* | 2/2020 | Marsden | G21K 1/025 |

* cited by examiner

ANTI-SCATTER COLLIMATOR FOR RADIATION IMAGING MODALITIES

CROSS-REFERENCE TO RELATED APPLICATIONS

This application is a national phase entry under 35 U.S.C. § 371 of International Patent Application PCT/US2017/032057, filed May 11, 2017, designating the United States of America and published as International Patent Publication WO 2018/208300 A1 on Nov. 15, 2018.

TECHNICAL FIELD

The present disclosure relates to an anti-scatter collimator for radiation imaging modalities (e.g., imaging modalities that utilize radiation to examine an object). It finds particular application in the context of computed tomography (CT) scanners. However, the features described herein are not intended to be limited to CT applications and may be used for other radiation imaging applications.

BACKGROUND

Today, CT and other radiation imaging modalities (e.g., mammography, digital radiography, single-photon emission computed tomography, etc.) are useful to provide information, or images, of interior aspects of an object under examination. Generally, the object is exposed to radiation (e.g., X-rays, gamma rays, etc.), and an image(s) is formed based upon the radiation absorbed and/or attenuated by the interior aspects of the object, or rather an amount of radiation photons that is able to pass through the object. Typically, highly dense aspects of the object (or aspects of the object having a composition comprised of higher atomic number elements) absorb and/or attenuate more radiation than less dense aspects, and thus an aspect having a higher density (and/or high atomic number elements), such as a bone or metal, for example, will be apparent when surrounded by less dense aspects, such as muscle or clothing.

Radiation imaging modalities generally comprise, among other things, one or more radiation sources (e.g., an X-ray source, gamma-ray source, etc.) and a detector array comprised of a plurality of pixels (also referred to as cells) that are respectively configured to convert radiation that has traversed the object into signals that can be processed to produce the image(s). As an object is passed between the radiation source(s) and the detector array, radiation is absorbed/attenuated by the object, causing changes in the amount/energy of detected radiation. Using information derived from the detected radiation, radiation imaging modalities are configured to generate images that can be used to detect items within the object that can be of particular interest (e.g., body characteristics, threat items, etc.). These images can be two-dimensional images or three-dimensional images.

In an ideal environment, the radiation that is detected by a pixel corresponds to primary radiation that strikes the pixel on a straight axis from a focal spot of the radiation source. However, some of the radiation that impinges upon the object is scattered, and deviates from a straight path. Scattered radiation, also referred to as secondary radiation, which is detected by a pixel reduces the quality of an image produced based upon the detector signal.

To reduce the possibility of scattered radiation impacting a pixel of the detector array, anti-scatter collimators can be inserted between the examination region and the detector array. These anti-scatter collimators comprise anti-scatter plates, also referred to as septa, which are configured to absorb scattered radiation while allowing primary radiation to pass through the collimator and be detected by a pixel of the detector array. The septa are aligned with respect to the radiation source and the detector array to allow the primary radiation to pass through while absorbing the secondary radiation. In addition, a mask may be oriented over gaps between scintillators of pixels so as to limit radiation from impinging upon reflective material that is disposed within the gaps. Systems with large septa utilize fixation structures to maintain the septa in place. Despite the use of these fixation structures, unintended vibration and motion of the septa can occur, which results in reduced image quality.

BRIEF SUMMARY

Aspects of the present disclosure address the above matters, and others. According to one aspect, an anti-scatter collimator comprises a first anti-scatter structure defining a retaining member. The retaining member comprises a first protruding member having a top surface defining a first plane and a second protruding member having a second top surface defining a second plane. The second protruding member is spaced apart from the first protruding member to define a groove. A support member extends between the first protruding member and the second protruding member. The support member defines a bottom surface of the groove. The bottom surface of the support member is spaced a distance apart from the first plane and the second plane. A second anti-scatter structure comprises a septum disposed within the groove. The first protruding member, the second protruding member, and the support member maintain a position of the septum relative to the first anti-scatter structure.

According to another aspect, an anti-scatter collimator comprises a first anti-scatter structure defining a retaining member. The retaining member comprises a first protruding member and a second protruding member spaced apart from the first protruding member to define a groove. A support member extends between the first protruding member and the second protruding member. The support member defines a bottom surface of the groove. The first protruding member and the support member at least partially define an opening that passes through the first anti-scatter structure between a first side and a second side of the first anti-scatter structure. A second anti-scatter structure comprises a septum disposed within the groove. The first protruding member, the second protruding member, and the support member maintain a position of the septum relative to the first anti-scatter structure.

According to another aspect, an anti-scatter collimator comprises a first layer defining a first retaining member at a first surface of the first layer. The first layer has a first attenuation coefficient. A first anti-scatter structure defines a second retaining member at a first surface of the first anti-scatter structure. The first surface of the anti-scatter structure faces the first surface of the first layer. The first anti-scatter structure has a second attenuation coefficient that is greater than the first attenuation coefficient. A second anti-scatter structure comprises a septum disposed between the first layer and the first anti-scatter structure. The septum physically contacts the first retaining member and the second retaining member. The first retaining member and the second retaining member maintain a position of the septum relative to the first layer and the first anti-scatter structure. The septum has a third attenuation coefficient that is greater than the first attenuation coefficient.

Those of ordinary skill in the art will appreciate still other aspects of the present disclosure upon reading and understanding the appended description.

BRIEF DESCRIPTION OF THE DRAWINGS

This disclosure is illustrated by way of example and not limitation in the figures of the accompanying drawings, in which like references generally indicate similar elements and in which.

DETAILED DESCRIPTION

Figure 1:
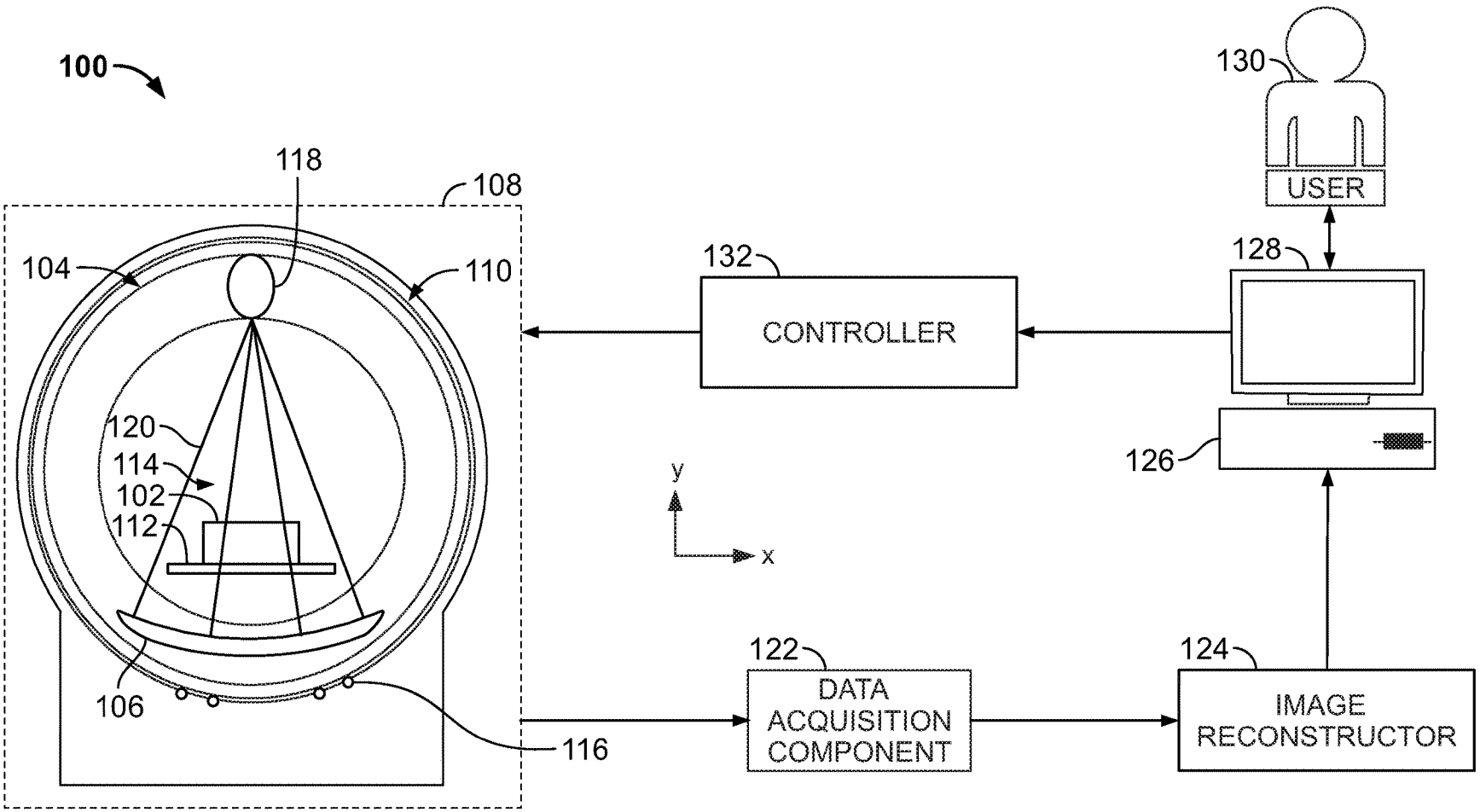
FIG. 1 illustrates an example environment of an imaging modality.

The claimed subject matter is now described with reference to the drawings, wherein like reference numerals are generally used to refer to like elements throughout. In the following description, for purposes of explanation, numerous specific details are set forth in order to provide a thorough understanding of the claimed subject matter. It can be evident, however, that the claimed subject matter can be practiced without these specific details. In other instances, structures and devices are illustrated in block diagram form in order to facilitate describing the claimed subject matter.

The present disclosure relates to an anti-scatter collimator that may be positioned between a radiation source and a detector array. The anti-scatter collimator has a first layer, a first anti-scatter structure, and a second anti-scatter structure. The first layer has a first retaining member for maintaining a position of septa of the second anti-scatter structure relative to the first player. The second anti-scatter structure has a second retaining member for maintaining a position of the septa of the second anti-scatter structure relative to the first anti-scatter structure. In this way, each septum of the plurality of septa is sandwiched between the first layer and the first anti-scatter structure (e.g., in a direction of travel between the radiation source and the detector array) to fixedly secure the position of each septum.

The plurality of septa can be spaced apart to define transmission channels through which primary radiation can travel substantially unimpeded. The first anti-scatter structure can define at least one opening that passes through the first anti-scatter structure. In this way, by being positioned between the radiation source and the detector array, radiation transmitted from the radiation source passes through the anti-scatter collimator prior to being received by the detector array. Due to the orientation of the anti-scatter collimator relative to the radiation source and the detector array, the first anti-scatter structure and the second anti-scatter structure can absorb or attenuate at least some radiation while allowing other radiation to pass through the transmission channels of the second anti-scatter structure and the openings of the first anti-scatter structure to reach the detector array. Moreover, in embodiments where a data acquisition component or other electronic components is disposed below or inside of the detector array, the anti-scatter collimator can further shield the electronic components from radiation.

FIG. 1 is an illustration of an example environment 100 comprising an example radiation imaging modality that can be configured to generate data (e.g., images) representative of an object 102 or aspect(s) thereof under examination. It will be appreciated that the features described herein can find applicability to other imaging modalities besides the example computed tomography (CT) scanner illustrated in FIG. 1. Moreover, the arrangement of components and/or the types of components included in the example environment 100 are for illustrative purposes only. For example, the rotating structure 104 (e.g., a rotating gantry) can comprise additional components to support the operation of a radiation source 118 and/or detector array 106, such as a cooling unit, power units, etc. As another example, a data acquisition component 122 can be comprised within and/or attached to the detector array 106.

In the example environment 100, an examination unit 108 of the imaging modality is configured to examine one or more objects 102. The examination unit 108 can comprise a rotating structure 104 and a (stationary) support structure 110, also referred to herein as a frame, which can encase and/or surround as least a portion of the rotating structure 104 (e.g., as illustrated with an outer, stationary ring, surrounding an outside edge of an inner, rotating ring). During an examination of the object(s) 102, the object(s) 102 can be placed on an object support 112, such as a bed or conveyor belt, for example, that is selectively positioned in an examination region 114 (e.g., a hollow bore in the rotating structure 104), and the rotating structure 104 can be rotated and/or supported about the object(s) 102 by a rotator 116, such as a bearing, motor, belt drive unit, drive shaft, chain, roller truck, etc.

The rotating structure 104 can surround a portion of the examination region 114 and can comprise one or more radiation sources 118 (e.g., an ionizing X-ray source, gamma radiation source, etc.) and one or more detector arrays 106 that are mounted on a substantially diametrically opposite side of the rotating structure 104 relative to the radiation source(s) 118.

During an examination of the object(s) 102, the radiation source(s) 118 emits fan or cone shaped radiation 120 from a focal spot(s) of the radiation source(s) 118 (e.g., a region within the radiation source(s) 118 from which radiation 120 emanates) into the examination region 114. It will be appreciated that such radiation 120 can be emitted substantially continuously and/or can be emitted intermittently (e.g., a brief pulse of radiation is emitted followed by a resting period during which the radiation source 118 is not activated).

As the emitted radiation 120 traverses the object(s) 102, the radiation 120 can be attenuated differently by different aspects of the object(s) 102. Because different aspects attenuate different percentages of the radiation 120, an image(s) can be generated based upon the attenuation, or variations in the number of photons that are detected by the detector array 106. For example, more dense aspects of the object(s) 102, such as a bone or metal plate, can attenuate more of the radiation 120 (e.g., causing fewer photons to strike the detector array 106) than less dense aspects, such as skin or clothing.

The detector array 106 can comprise a linear (e.g., one-dimensional) or two-dimensional array of pixels (sometimes referred to as cells or elements) disposed as a single row or multiple rows typically having a center of curvature at the focal spot of the radiation source(s) 118, for example. As the rotating structure 104 rotates, the detector array 106 is configured to directly convert (e.g., using amorphous selenium, cadmium zinc telluride (CdZnTe), and/or other direct conversion materials) and/or indirectly convert (e.g., using a scintillator material such as Cesium Iodide (CsI), gadolinium oxysulfide (GOS), cadmium tungstate ($CdWO_4$), and/or other indirect conversion materials) detected radiation into electrical signals (e.g., wherein the detected radiation is converted to light, and a photodiode converts the light to electrical signals).

Signals that are produced by the detector array 106 can be transmitted to a data acquisition component 122 that is in operable communication with the detector array 106. Typically, the data acquisition component 122 is configured to convert the electrical signals output by the detector array 106 into digital data The example environment 100 also illustrates an image reconstructor 124 that is operably coupled to the data acquisition component 122 and is configured to generate one or more images representative of the object 102 under examination based at least in part upon signals output from the data acquisition component 122 using suitable analytical, iterative, and/or other reconstruction technique (e.g., tomosynthesis reconstruction, back-projection, iterative reconstruction, etc.).

The example environment 100 also includes a terminal 126, or workstation (e.g., a computer), configured to receive image(s) from the image reconstructor 124, which can be displayed on a monitor 128 to a user 130 (e.g., security personnel, medical personnel, etc.). In this way, the user 130 can inspect the image(s) to identify areas of interest within the object(s) 102. The terminal 126 can also be configured to receive user input, which can direct operations of the examination unit 108 (e.g., a speed of rotation for the rotating structure 104, an energy level of the radiation, etc.).

In the example environment 100, a controller 132 is operably coupled to the terminal 126. In one example, the controller 132 is configured to receive user input from the terminal 126 and generate instructions for the examination unit 108 indicative of operations to be performed.

It will be appreciated that the example component diagram is merely intended to illustrate one embodiment of one type of imaging modality and is not intended to be interpreted in a limiting manner. For example, the functions of one or more components described herein can be separated into a plurality of components and/or the functions of two or more components described herein can be consolidated into merely a single component. Moreover, the imaging modality can comprise additional components to perform additional features, functions, etc. (e.g., such as automatic threat detection).

Figure 2:
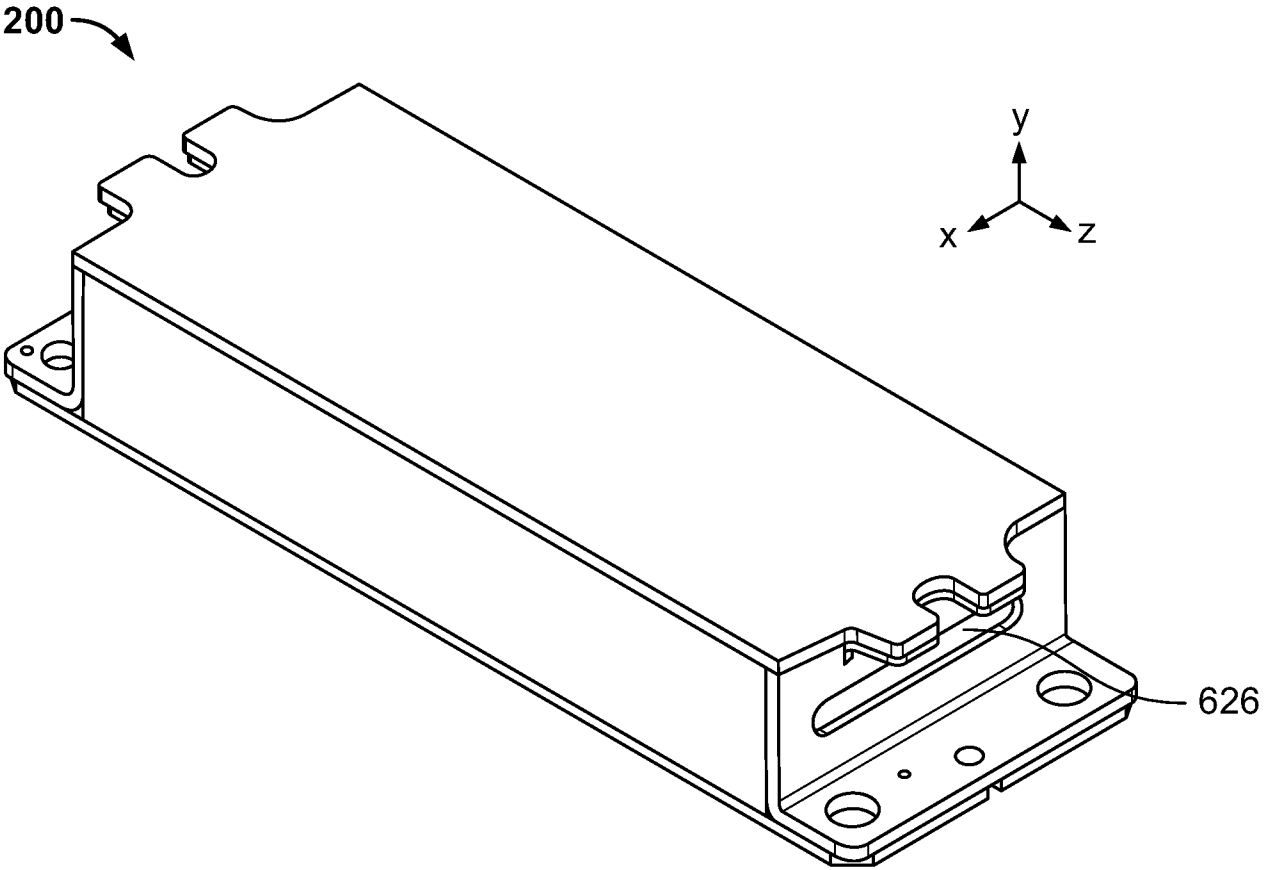
FIG. 2 illustrates an example anti-scatter collimator.

FIG. 2 illustrates an example anti-scatter collimator 200. The anti-scatter collimator 200 comprises a plurality of anti-scatter structures, wherein one anti-scatter structure is a one-dimensional anti-scatter structure, while another anti-scatter structure is a two-dimensional anti-scatter structure. The anti-scatter collimator 200 can be disposed between the radiation source 118 and the detector array 106. For example, in some embodiments, the anti-scatter collimator 200 is mounted to an upper surface of the detector array 106 that faces the radiation source 118. The anti-scatter collimator 200 is configured to absorb, or otherwise alter secondary radiation, such that it is not detected by channels of the detector array 106, while allowing primary radiation to pass through (e.g., along the y-direction). An opening 626 defined in an end support of anti-scatter collimator 200 is illustrated by FIG. 2.

Figure 3:
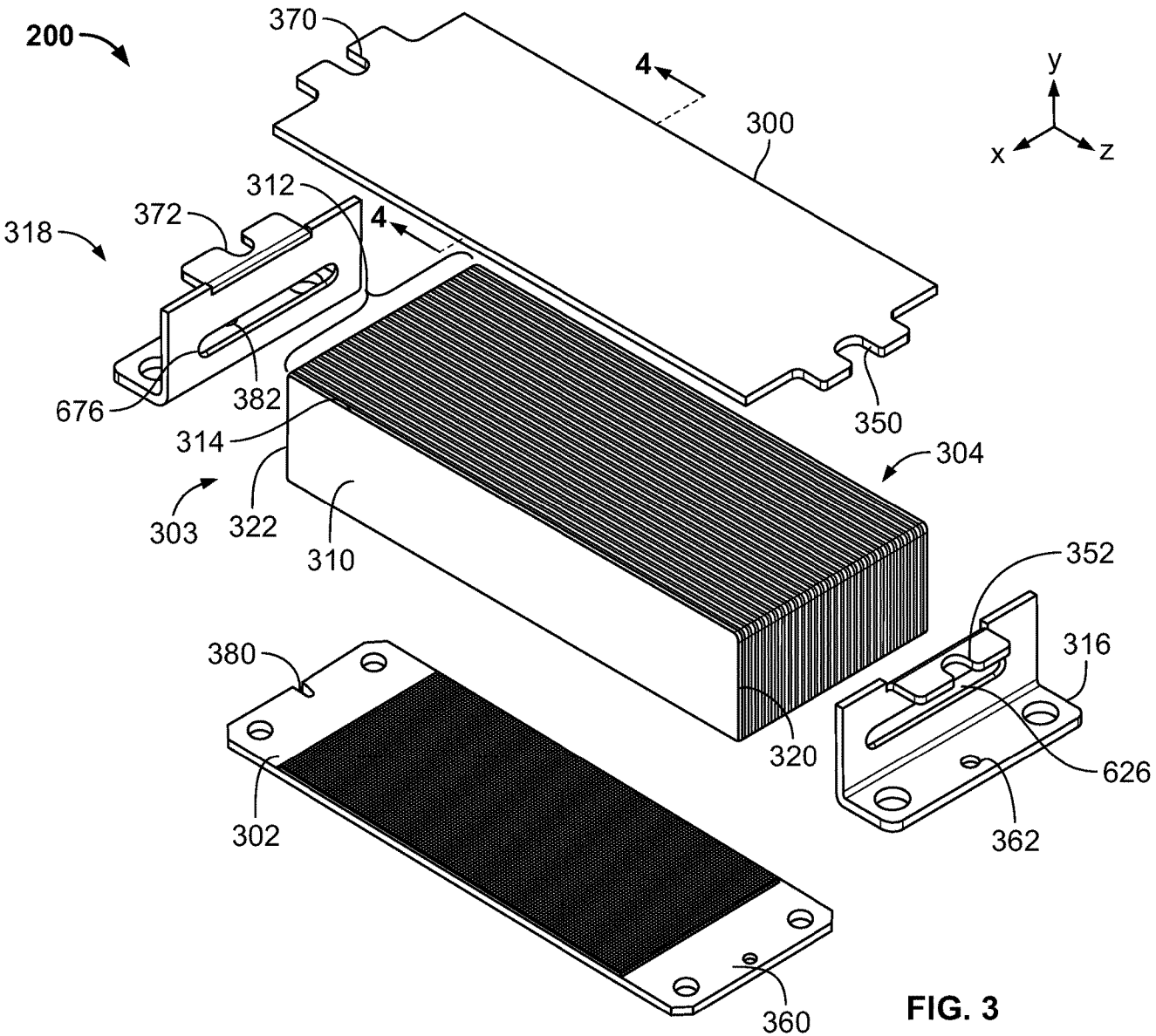
FIG. 3 illustrates an exploded view of an example anti-scatter collimator.

Referring to FIG. 3, an exploded view of the anti-scatter collimator 200 is illustrated. The anti-scatter collimator 200 comprises a first layer 300 and a first anti-scatter structure 302. The first layer 300 and the first anti-scatter structure 302 can extend substantially parallel to one another, and can be positioned to extend substantially perpendicular to a direction along which the radiation impinges upon the anti-scatter collimator 200 (e.g., along the y-direction). A material composition of the first layer 300 can have a first attenuation coefficient. A material composition of the first anti-scatter structure 302 can have a second attenuation coefficient. In an example, the second attenuation coefficient of the material of the first anti-scatter structure 302 may be different than (e.g., greater than) the first attenuation coefficient of the material of the first layer 300. In an example, radiation can pass through the first layer 300 without being attenuated, absorbed, etc.

In an example, the first layer 300 may comprise a carbon fiber material with a thickness that is between about 0.5 millimeters (mm) to about 1.5 mm, or between about 0.75 mm to about 1.25 mm, or about 1 mm, although other materials and/or thicknesses are contemplated. The material and thickness of the first layer 300 is typically selected to minimize radiation attenuation. For example, the material and thickness of first layer 300 may be selected to attenuate less than about 1% to 3%.

The anti-scatter collimator 200 comprises a second anti-scatter structure 303. In an example, the second anti-scatter structure 303 comprises a plurality of anti-scatter plates, or a set 304 of septa. The set 304 of septa are configured to absorb, attenuate, or otherwise alter secondary radiation so that it is not detected by the channels of the detector array. The set 304 of septa can comprise, for example, molybdenum, tungsten, and/or any other material that has characteristics that allow for absorption or otherwise alteration of radiation striking the set 304 of septa. The second anti-scatter structure 303 can be referred to as a one-dimensional anti-scatter structure, while the first anti-scatter structure 302 can be referred to as a two-dimensional anti-scatter structure.

In an example, a septum 310 and a plurality of other septa 312 (e.g., illustrated in FIG. 4) can together define the set 304 of septa. The set 304 of septa can be disposed between the first layer 300 and the first anti-scatter structure 302. In an example, the septum 310 and the septa 312 of the second anti-scatter structure can have a third attenuation coefficient that is substantially similar to or identical to the second attenuation coefficient of the first anti-scatter structure 302. In an example, the first attenuation coefficient may be less than the second attenuation coefficient and the third attenuation coefficient. The first attenuation coefficient is such that primary radiation and secondary radiation can pass through the first layer 300. The second attenuation coefficient and the third attenuation coefficient are such that radiation impinging upon a septum of the set 304 and/or portions of the first anti-scatter structure 302 may be absorbed and/or attenuated.

In an example, the first anti-scatter structure 302 and/or the second anti-scatter structure 303 may comprise a tungsten material (e.g., tungsten epoxy) with a thickness that is between about 50 micrometers (μm) to about 150 μm, or between about 75 μm to about 125 μm, or about 100 μm. In addition or in the alternative to the tungsten material, the first anti-scatter structure 302 and/or the second anti-scatter structure 303 may comprise other materials such as one or more of molybdenum, gold, thallium, lead, etc.

The septa 310, 312 are spaced apart to define transmission channels 314 (e.g., also illustrated in FIG. 4) between adjacent septa 310, 312. In an example, the transmission channels 314 are configured to allow primary radiation to pass through the anti-scatter collimator 200 (e.g., along the y-direction), whereupon the primary radiation can be detected by the underlying detector array 106. In this way, primary radiation can pass through the transmission channels 314 while the secondary radiation may be absorbed and/or attenuated by the septa 310, 312. As such, the secondary radiation is not detected by the underlying detector array 106.

The anti-scatter collimator 200 comprises one or more end supports for supporting the set 304 of septa, such as an end support 316 and a second end support 318. The end support 316 can be attached to the first layer 300 and the first anti-scatter structure 302. The end support 316 can be attached to the first layer 300 and the first anti-scatter structure 302 in a number of ways, such as with mechanical fasteners (e.g., bolts, screws, etc.), adhesives, etc. By being attached to the first layer 300 and the first anti-scatter structure 302, the end support 316 can maintain the relative positions of the first layer 300 and the first anti-scatter structure 302. The end support 316 and the second end support 318 may comprise, for example, a substantially rigid material such as a metal, a plastic, etc. An opening 676 defined in end support 318 of anti-scatter collimator 200 is illustrated by FIG. 3.

The second end support 318 can be attached to the first layer 300 and the first anti-scatter structure 302 in a number of ways, such as with mechanical fasteners (e.g., bolts, screws, etc.), adhesives, etc. By being attached to the first layer 300 and the first anti-scatter structure 302, the second end support 318 can maintain the relative positions of the first layer 300 and the first anti-scatter structure 302. For example, the end support 316 and the second end support 318 can hold the first layer 300 and the first anti-scatter structure 302 at a fixed distance from each other, and limit inadvertent movement of the first layer 300 and the first anti-scatter structure 302.

In an example, the end support 316 can border an end 320 of the set 304 of septa, while the second end support 318 can border a second end 322 of the set 304 of septa. In this way, the set 304 of septa can be positioned between the end support 316 and the second end support 318. As such, the end support 316 and the second end support 318 can maintain a relative position of the set 304 of septa with respect to the end supports 316, 318.

The first layer 300 can be attached to the end support 316 in any number of ways. In an example, the first layer 300 defines a first layer opening 350 at an end of the first layer 300. The end support 316 defines a first support opening 352. In an example, the first layer opening 350 of the first layer 300 can be aligned with the first support opening 352 of the end support 316. In this way, a fastener can be received through the first layer opening 350 and the first support opening 352 to attach the first layer 300 and the end support 316. Moreover, this first layer opening 350 and the first support opening 352 can be used to ensure alignment of the end support 316 and the first layer.

The first anti-scatter structure 302 can be attached to the end support 316 in any number of ways. In an example, the first anti-scatter structure 302 defines a second structure opening 360 at an end of the first anti-scatter structure 302. The end support 316 defines a second support opening 362. In an example, the second structure opening 360 of the first anti-scatter structure 302 can be aligned with the second support opening 362 of the end support 316. In this way, a fastener can be received through the second structure opening 360 and the second support opening 362 to attach the first anti-scatter structure 302 and the end support 316. Moreover, this second structure opening 360 and the second support opening 362 can be used to ensure alignment of the end support 316 and the first anti-scatter structure 302.

The first layer 300 can be attached to the second end support 318 in any number of ways. In an example, the first layer 300 defines a third layer opening 370 at an end of the first layer 300. The second end support 318 defines a third support opening 372. In an example, the third layer opening 370 of the first layer 300 can be aligned with the third support opening 372 of the second end support 318. In this way, a fastener can be received through the third layer opening 370 and the third support opening 372 to attach the first layer 300 and the second end support 318. Moreover, this third layer opening 370 and the third support opening 372 can be used to further ensure alignment of the end support 316 and the first layer.

The first anti-scatter structure 302 can be attached to the second end support 318 in any number of ways. In an example, the first anti-scatter structure 302 defines a fourth structure opening 380 at an end of the first anti-scatter structure 302. The second end support 318 defines a fourth support opening 382. In an example, the fourth structure opening 380 of the first anti-scatter structure 302 can be aligned with the fourth support opening 382 of the second end support 318. In this way, a fastener can be received through the fourth structure opening 380 and the fourth support opening 382 to attach the first anti-scatter structure 302 and the second end support 318. Moreover, this fourth structure opening 380 and the third support opening 372 can be used to further ensure alignment of the end support 316 and the first layer 300.

Figure 4:
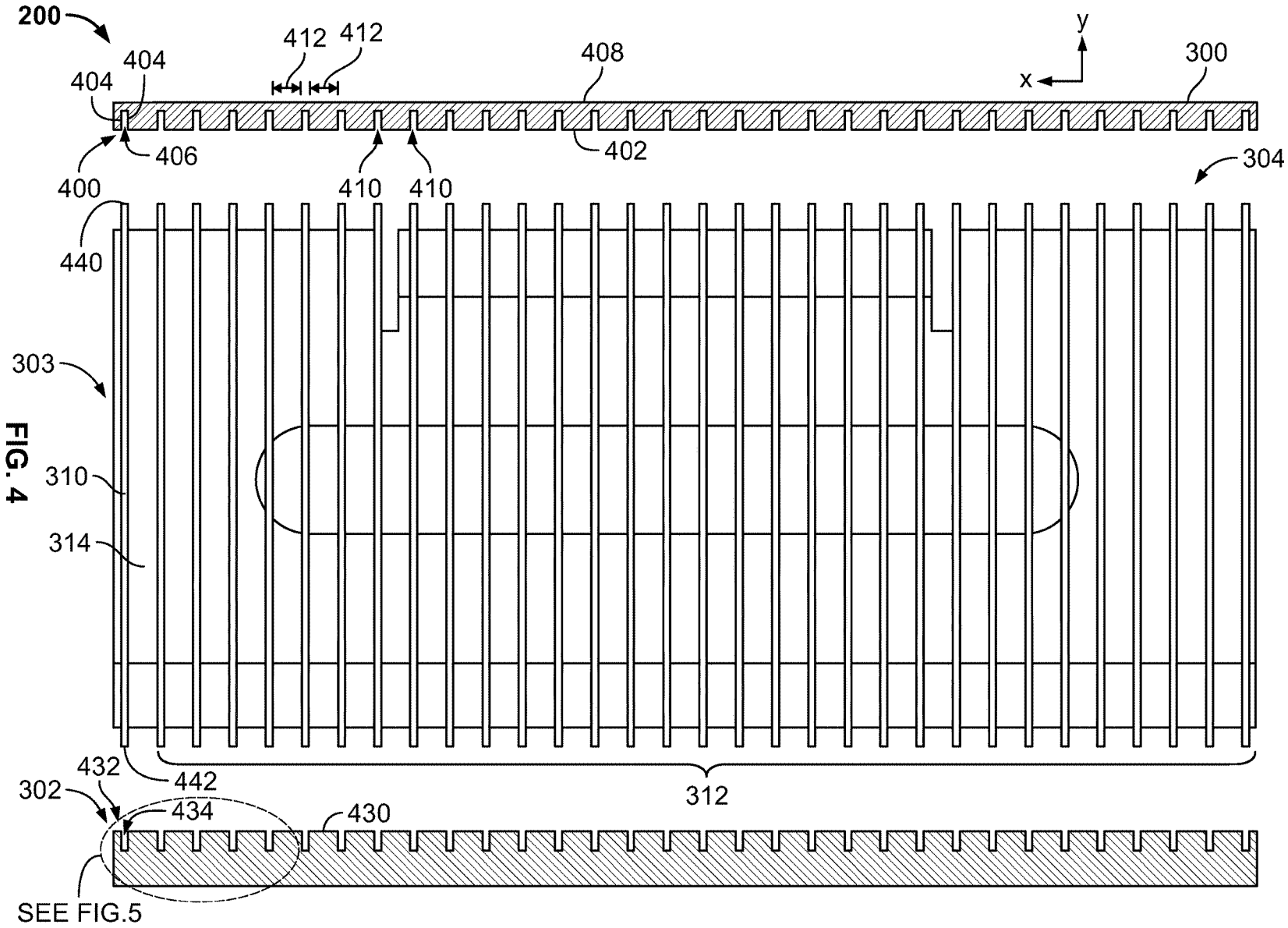
FIG. 4 illustrates an exploded sectional view of an example anti-scatter collimator in which septa are not attached to a first layer or a first anti-scatter structure.

Referring to FIG. 4, an exploded sectional view of the anti-scatter collimator 200 along lines 4-4 of FIG. 3 is illustrated. The first layer 300 defines one or more retaining members at a first surface 402. For example, the first layer 300 can define a first retaining member 400 at the first surface 402. In an example, the first surface 402 faces toward the septum 310 and the first anti-scatter structure 302.

The first retaining member 400 comprises a pair of first sidewalls 404 of the first layer 300. The first sidewalls 404 can define a first groove 406. The first groove 406 can therefore be defined in the first layer 300 and extend from the first surface 402 toward a second surface 408 that is opposite the first surface 402 of the first layer 300. A plurality of first grooves 410 can be defined in the first surface 402 of the first layer 300. The first grooves 410 can extend substantially parallel to each other. In an example, a pitch 412 at the first surface 402 between each first groove can be substantially constant. In another example, the pitch 412 at the first surface 402 between each first groove can be non-constant and/or different.

In an example, the first anti-scatter structure 302 defines one or more retaining members at a first surface 430. In an example, the first surface 430 faces toward the septa 310, 312 and the first layer 300. The first anti-scatter structure 302 can define a second retaining member 432 at the first surface 430. In an example, the second retaining member 432 can define a groove 434 at the first surface 430.

The septa 310, 312 can be disposed between the first layer 300 and the first anti-scatter structure 302. In an example, the septa 310, 312 can extend substantially perpendicular to the first layer 300 and the first anti-scatter structure 302. In an example, a first end 440 of the septa 310, 312 can be positioned in proximity to the first layer 300 while a second end 442 can be positioned in proximity to the first anti-scatter structure 302. In an example, the first end 440 of the septa 310, 312 can be received within the first groove 406 such that the first end 440 is positioned between the first surface 402 of the first layer 300 and the second surface 408 of the first layer 300. In an example, the second end 442 of the septa 310, 312 can physically contact and engage the second retaining member 432 so as to be received within the groove 434 of the second retaining member 432.

Figure 5:
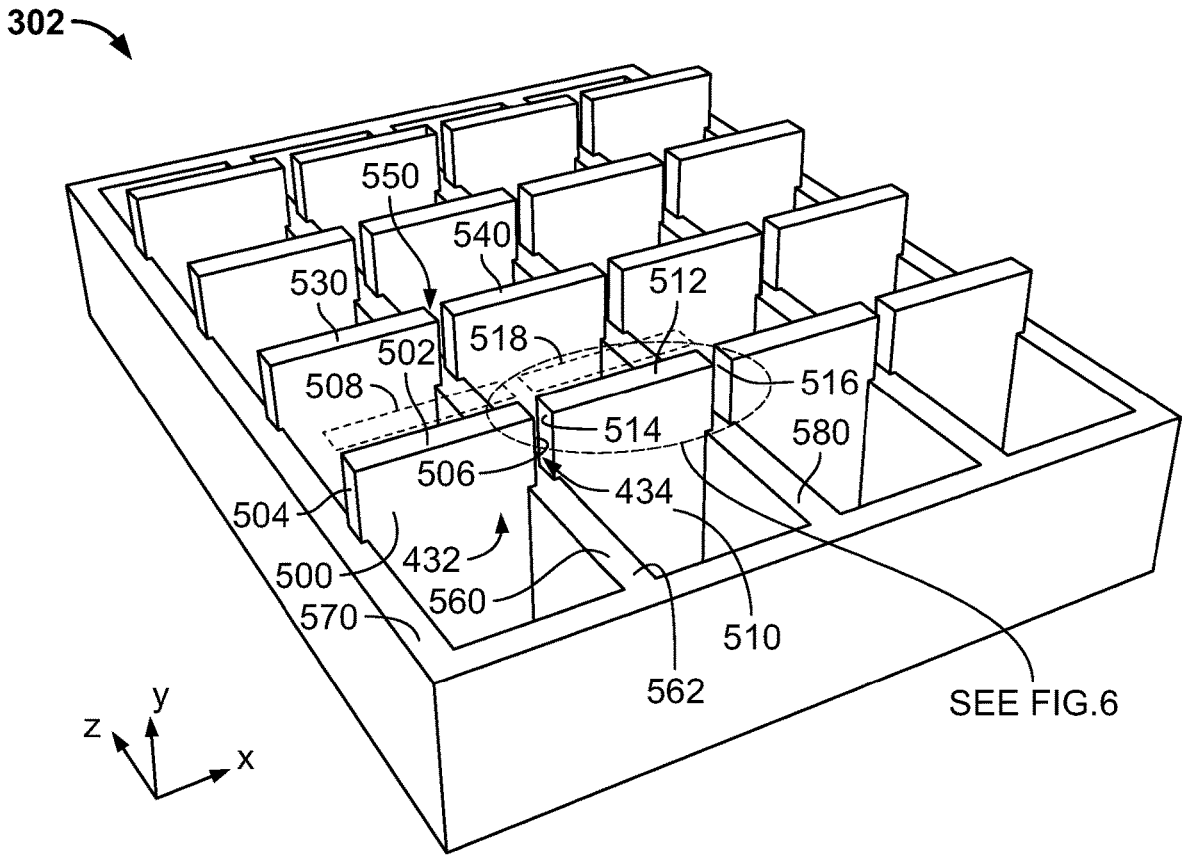
FIG. 5 illustrates a perspective view of an example first anti-scatter structure.

Referring to FIG. 5, a portion of the first anti-scatter structure 302 is illustrated. The first anti-scatter structure 302 can be manufactured in any number of ways. For example, the first anti-scatter structure 302 can be manufactured by a chemical etching process, by laser sintering of a powder material (e.g., Tungsten), by casting of a material (e.g., Tungsten-polymer material), etc. The second retaining member 432 of the first anti-scatter structure 302 comprises one or more protruding members. For example, the second retaining member 432 comprises a first protruding member 500. The first protruding member 500 comprises a substantially quadrilateral shaped (e.g., rectangular) structure. The first protruding member 500 can have a thickness that is between about 150 μm to about 210 μm, or about 180 μm.

In an example, the first protruding member 500 comprises a top surface 502, a first lateral surface 504, and a second lateral surface 506. In an example, the top surface 502 can face toward the first layer 300. In an example, the top surface 502 can define a first plane 508 that is substantially parallel to the first layer 300. The first lateral surface 504 and the second lateral surface 506 can extend substantially perpendicular to the top surface 502 and the first layer 300. In an example, the first lateral surface 504 and the second lateral surface 506 can extend substantially parallel to each other, and may define sides of the first protruding member 500.

The second retaining member 432 of the first anti-scatter structure 302 comprises a second protruding member 510. The second protruding member 510 comprises a substantially quadrilateral shaped (e.g., rectangular) structure. In an example, the second protruding member 510 is substantially similar or identical to the first protruding member 500. For example, the second protruding member 510 comprises a second top surface 512, a third lateral surface 514, and a fourth lateral surface 516. In an example, the second top surface 512 can face toward the first layer 300. In an example, the second top surface 512 can define a second plane 518 that is substantially parallel to the first layer 300. The second plane 518 of the second top surface 512 may be co-planar with the first plane 508 of the top surface 502. The third lateral surface 514 and the fourth lateral surface 516 can extend substantially perpendicular to the second top surface 512 and the first layer 300. In an example, the third lateral surface 514 and the fourth lateral surface 516 can extend substantially parallel to each other and to the first lateral surface 504 and the second lateral surface 506. The third lateral surface 514 and the fourth lateral surface 516 may define sides of the second protruding member 510.

Figure 8:
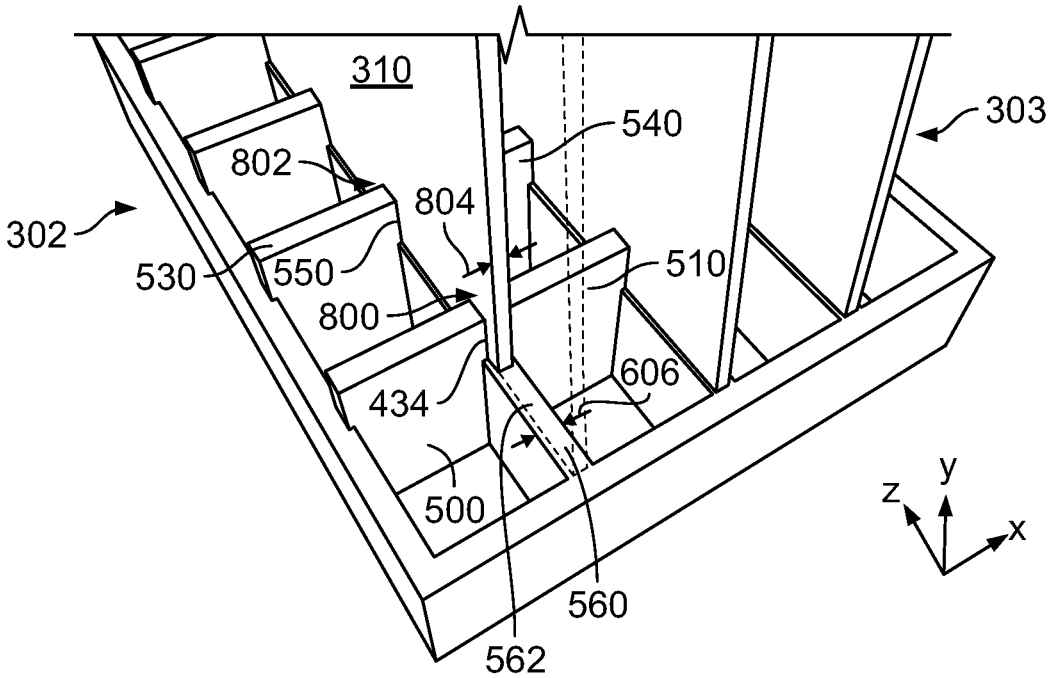
FIG. 8 illustrates an example first anti-scatter structure for supporting one or more septa.
Figure 9:
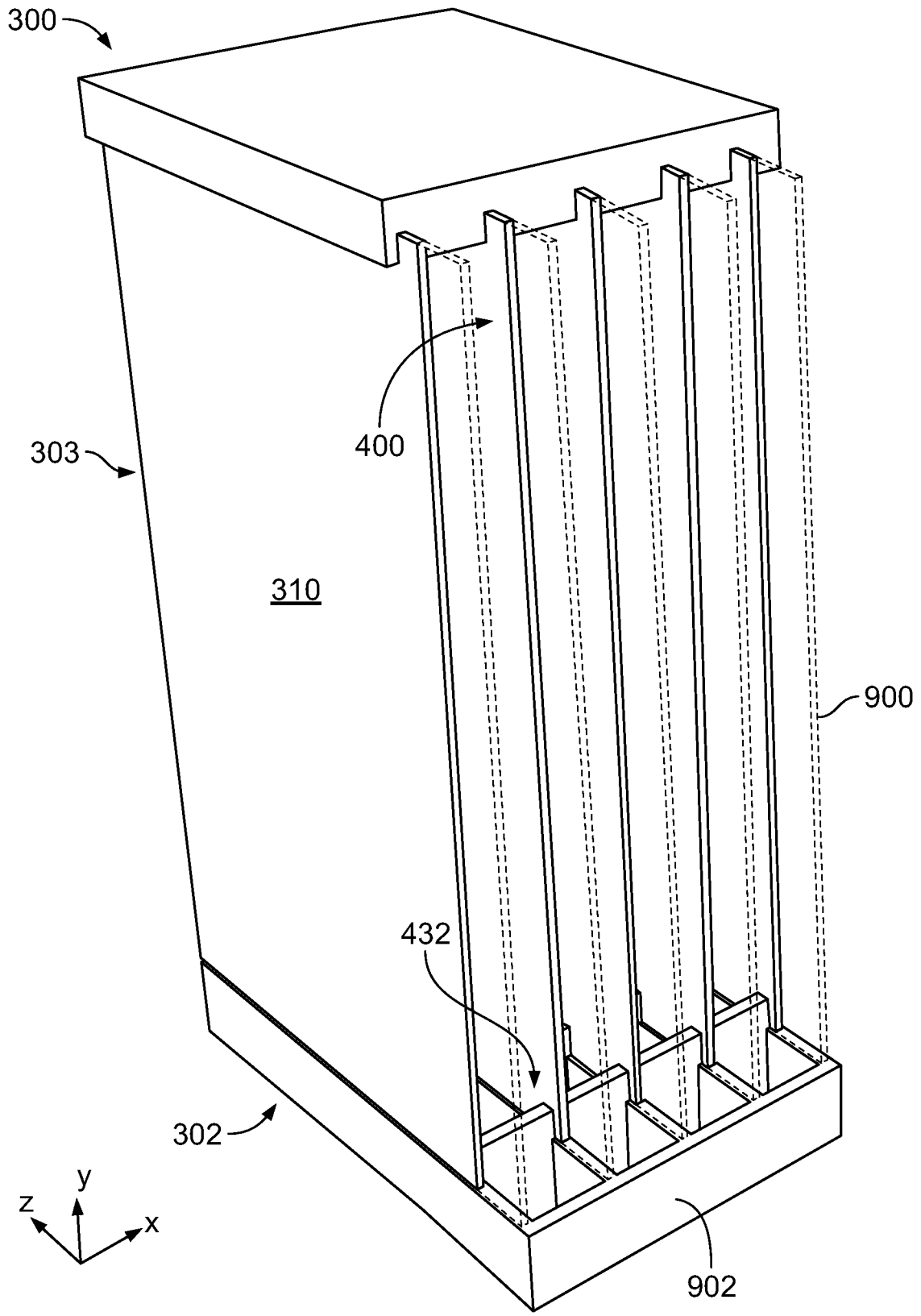
FIG. 9 illustrates an example first layer and first anti-scatter structure for supporting one or more septa.

In an example, the second protruding member 510 may be spaced apart from the first protruding member 500 to define the groove 434. The groove 434 may be sized to receive the septum 310 (e.g., as illustrated in FIGS. 8 and 9), such that, in operation, the septum 310 may be disposed within the groove 434. In this way, the first protruding member 500 and the second protruding member 510 can support and maintain the septum 310 relative to the first anti-scatter structure 302.

In an example, the second retaining member 432 comprises a third protruding member 530. The third protruding member 530 may be substantially similar or identical to the first protruding member 500 and the second protruding member 510. In an example, the third protruding member 530 may extend substantially parallel to and spaced apart from the first protruding member 500. In this way, an axis may extend substantially perpendicular to the first protruding member 500 and the third protruding member 530, while intersecting the first protruding member 500 and the third protruding member 530. The third protruding member 530 may comprise a top surface, lateral surfaces, etc.

In an example, the second retaining member 432 comprises a fourth protruding member 540. The fourth protruding member 540 may be substantially similar or identical to the first protruding member 500, the second protruding member 510, the third protruding member 530, etc. In an example, the fourth protruding member 540 may extend substantially parallel to and spaced apart from the second protruding member 510. In this way, an axis may extend substantially perpendicular to the second protruding member 510 and the fourth protruding member 540, while intersecting the second protruding member 510 and the fourth protruding member 540. The fourth protruding member 540 may comprise a top surface, lateral surfaces, etc.

The third protruding member 530 and the fourth protruding member 540 may extend substantially parallel to and co-planar with respect to each other. In an example, the fourth protruding member 540 may be spaced apart from the third protruding member 530 to define a second groove 550. The septum 310 (e.g., illustrated in FIGS. 3 and 4) may be disposed within the second groove 550 such that the third protruding member 530 and the fourth protruding member 540 can support and maintain the septum 310 relative to the first anti-scatter structure 302. In an example, the groove 434 and the second groove 550 can be aligned such that the septum 310 can be received in both the groove 434 and the second groove 550. As such, the septum 310 can be supported at a plurality of locations between a plurality of sets of protruding members. For example, the septum 310 can be supported between a first set of protruding members (e.g., the first protruding member 500 and the second protruding member 510) at a first location, and between a second set of protruding members (e.g., the third protruding member 530 and the fourth protruding member 540) at a second location, etc.

The retaining members 400, 432 can comprise a support member 560. In an example, the support member 560 can extend between the first protruding member 500 and the second protruding member 510, and between the third protruding member 530 and the fourth protruding member 540. In an example, the support member 560 can extend substantially perpendicular to the first protruding member 500, the second protruding member 510, the third protruding member 530 and the fourth protruding member 540. The support member 560 can define a bottom surface 562 of the groove 434 and the second groove 550.

The first anti-scatter structure 302 may comprise a second support member 570 and a third support member 580 that extend substantially parallel to and spaced apart from the support member 560. In an example, the support member 560 and the second support member 570 may be spaced apart, with the first protruding member 500 and the third protruding member 530 extending between the support member 560 and the second support member 570. In an example, the support member 560 and the third support member 580 may be spaced apart, with the second protruding member 510 and the fourth protruding member 540 extending between the support member 560 and the third support member 580.

It will be appreciated that the first anti-scatter structure 302 is not limited to the illustrated size, shape, dimension, etc. For example, while FIG. 5 illustrates the first anti-scatter structure 302 as having 4 by 5 openings (e.g., 4×5), other numbers of openings are envisioned, such as 16 by 16 openings (e.g., 16×16), 32 by 64 openings (e.g., 32×64), etc.

Figure 6:
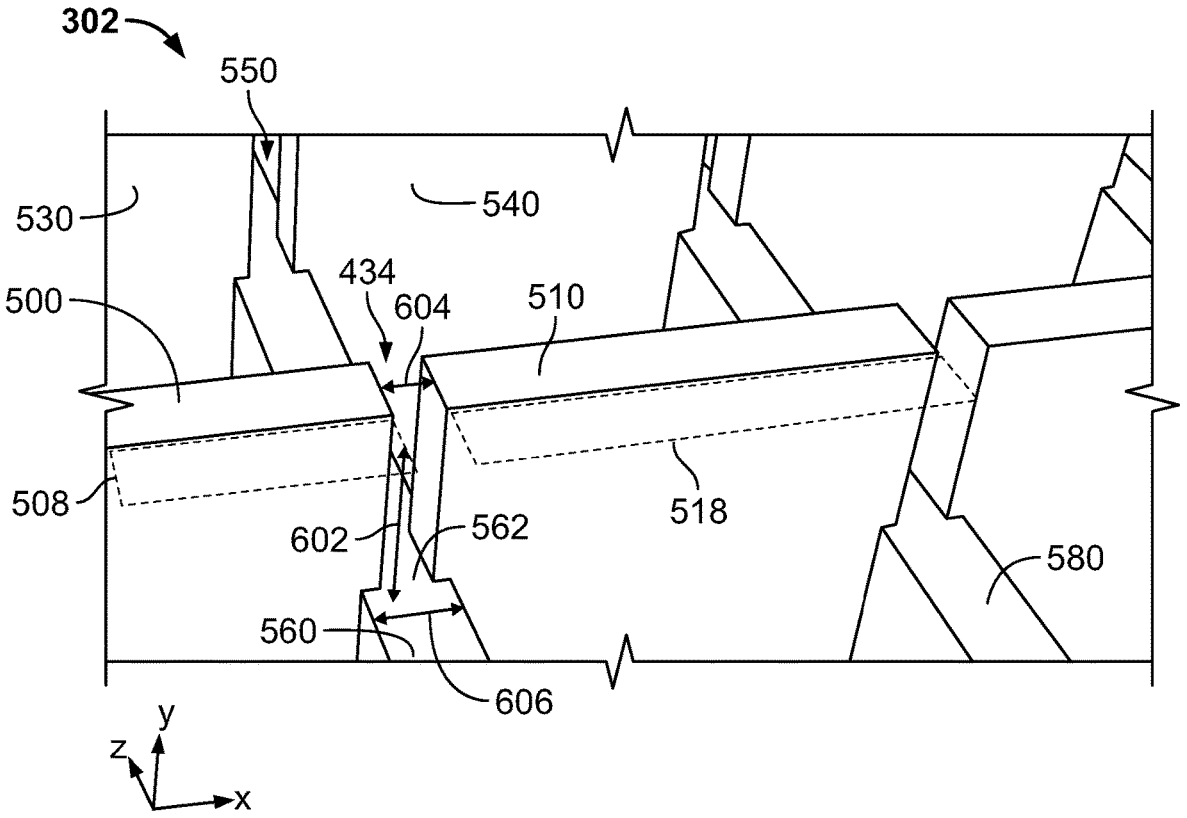
FIG. 6 illustrates a perspective view of an example first anti-scatter structure.

Referring to FIG. 6, the first protruding member 500, the second protruding member 510, and the support member 560 are illustrated. In an example, the support member 560 defines a surface (e.g., a bottom surface 562) of the groove 434. In an example, the bottom surface 562 of the support member 560 may be spaced a distance 602 apart from the first plane 508 of the top surface 502 and the second plane 518 of the second top surface 512. In an example, the distance 602 may be measured along an axis that is perpendicular to the bottom surface 562, the first plane 508, and the second plane 518.

In an example, the groove 434 can have a groove thickness 604 measured between the first protruding member 500 and the second protruding member 510. The groove thickness 604 may be measured along an axis that is perpendicular to the axis along which the distance 602 is measured. In an example, the groove thickness 604 may be between about 50 μm to about 150 μm, or about 100 μm. The support member 560 can have a support member thickness 606 that may be measured along an axis that is substantially parallel to the axis along which the groove thickness 604 is measured. In an example, the support member thickness 606 may be between about 150 μm to about 210 μm, or about 180 μm. In an example, the groove thickness 604 may be less than the support member thickness 606. In this way, the first protruding member 500 and the second protruding member 510 can at least partially overlap the support member 560 to provide additional structural support to the first anti-scatter structure 302.

Figure 7:
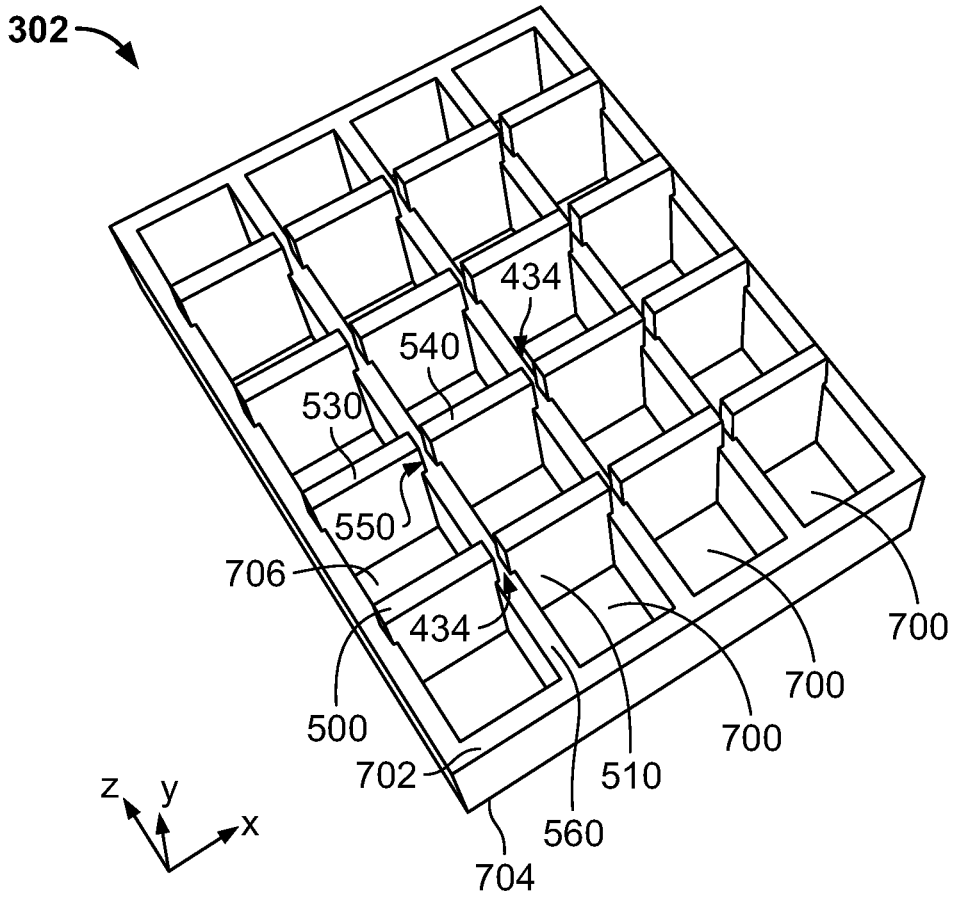
FIG. 7 illustrates a top-down view of an example first anti-scatter structure.

Referring to FIG. 7, in an example, the first anti-scatter structure 302 can define at least one opening 700 that passes through the first anti-scatter structure 302 between a first side 702 and a second side 704 of the first anti-scatter structure 302. In an example, the first side 702 can face toward the first layer 300 and the second anti-scatter structure 303. The second side 704 can be opposite the first side 702, with the second side 704 facing away from the first layer 300 and the second anti-scatter structure 303.

The at least one opening 700 can comprise, for example, a first opening 706. In an example, the first protruding member 500 and the support member 560 can at least partially define the first opening 706 that passes through the first anti-scatter structure 302 between the first side 702 and the second side 704. In an example, the first protruding member 500, the third protruding member 530, the support member 560, and the second support member 570 can define the first opening 706.

While the openings 700, 706 can comprise any number of different shapes, in the illustrated example of FIG. 7, the openings 700, 706 can comprise a quadrilateral shape (e.g., square shape) defined by the protruding members and the support members. In an example, the openings 700, 706 can have a length (e.g., as measured between opposing support members) and/or a width (e.g., as measured between opposing protruding members) that is between about 0.5 millimeters to about 1.5 millimeters, or about 1 millimeter. In an example, the openings 700, 706 can allow for radiation to pass through the first anti-scatter structure 302, while radiation that impinges upon the protruding members and support members may be attenuated.

Referring to FIG. 8, the protruding members and the support members can maintain a position of the septa of the second anti-scatter structure 303 relative to the first anti-scatter structure 302 by receiving the septa within the grooves. For example, the first protruding member 500, the second protruding member 510, and the support member 560 can maintain a position of the septum 310 relative to the first anti-scatter structure 302. In an example, the septum 310 of the second anti-scatter structure 303 can be received and disposed within the groove 434. Similarly, in an example, the septum 310 can be received and disposed within the second groove 550. In this way, the septum 310 can be supported between the first protruding member 500 and the second protruding member 510 at a first location 800. The septum 310 can be supported between the third protruding member 530 and the fourth protruding member 540 at a second location 802. As such, the protruding members 500, 510, 530, 540 can limit lateral movement (e.g., side to side movement along a direction that is substantially perpendicular to a plane along which the septum 310 lies) of the septum 310 when the septum 310 is received within the groove 434 and the second groove 550.

The septum 310 can rest upon the support member 560, such that the septum 310 may be in contact with the bottom surface 562 of the support member 560. In an example, the septum 310 can extend substantially parallel to the support member 560 and substantially perpendicular to the protruding members (e.g., the first protruding member 500, the second protruding member 510, the third protruding member 530, and the fourth protruding member 540). In an example, the septum 310 and the support member 560 may be co-planar. In this way, the septum 310 may not obstruct, block, or otherwise cover the openings 700, 706 defined within the first anti-scatter structure 302.

In an example, the septum 310 can have a septum thickness 804. In an example, the septum thickness 804 may be between about 50 μm to about 150 μm, or about 100 μm. The septum thickness 804 of the septum 310 may be less than or equal to the groove thickness 604 (e.g., illustrated in FIG. 6) of the groove 434. In this way, the septum 310 can be removably received within the groove 434. In an example, the support member thickness 606 of the support member 560 may be greater than the septum thickness 804 and the groove thickness 604 (e.g., illustrated in FIG. 6). The other septa of the second anti-scatter structure 303 can similarly be received within grooves defined between protruding members. It will be appreciated that the septum 310 in FIG. 8 is partially truncated and not in a final position so as to more clearly illustrate portions of the first anti-scatter structure 302 (e.g., the fourth protruding member 540, the support member 560, the support member thickness 606, etc.) that would be obstructed by the septum 310 in a final position. The final position of the septum 310 (e.g., during operation) is illustrated with dashed lines, such that a front edge (e.g., also illustrated in FIG. 9 at 900) of the septum 310 may be co-planar with front edges of the other septa (e.g., 303). Moreover, while FIG. 8 illustrates that septum 310 as terminating before a front edge of the first anti-scatter structure 302, it some embodiments, the septum 310 may extend such that the edge of the septum 310 is flush with or extends beyond the front edge of the first anti-scatter structure 302.

Referring to FIG. 9, a portion of the second anti-scatter structure 303 is illustrated as being supported by a portion of the first layer 300 and a portion of the first anti-scatter structure 302. In an example, the septum 310 may physically contact the first retaining member 400 of the first layer 300 and the second retaining member 432 of the first anti-scatter structure 302. In this way, the first retaining member 400 and the second retaining member 432 can maintain a position of the septum 310 relative to the first layer 300 and the first anti-scatter structure 302. As with the septum 310 illustrated in FIG. 8, front edges 900 of the septa of the second anti-scatter structure 303 are truncated in FIG. 9 and spaced apart from a front edge 902 of the first anti-scatter structure 302 so as not to obstruct portions of the first anti-scatter structure 302 from view. However, in operation, the front edges 900 may be in closer proximity to and/or flush with the front edge 902 of the first anti-scatter structure 302 (e.g., as represented by the dashed lines). Moreover, while FIG. 9 illustrates that septum 310 as terminating before the front edge 902 of the first anti-scatter structure 302, in some embodiments, the septum 310 may extend such that the edge of the septum 310 is flush with or extends beyond the front edge 902 of the first anti-scatter structure 302.

Figure 10:
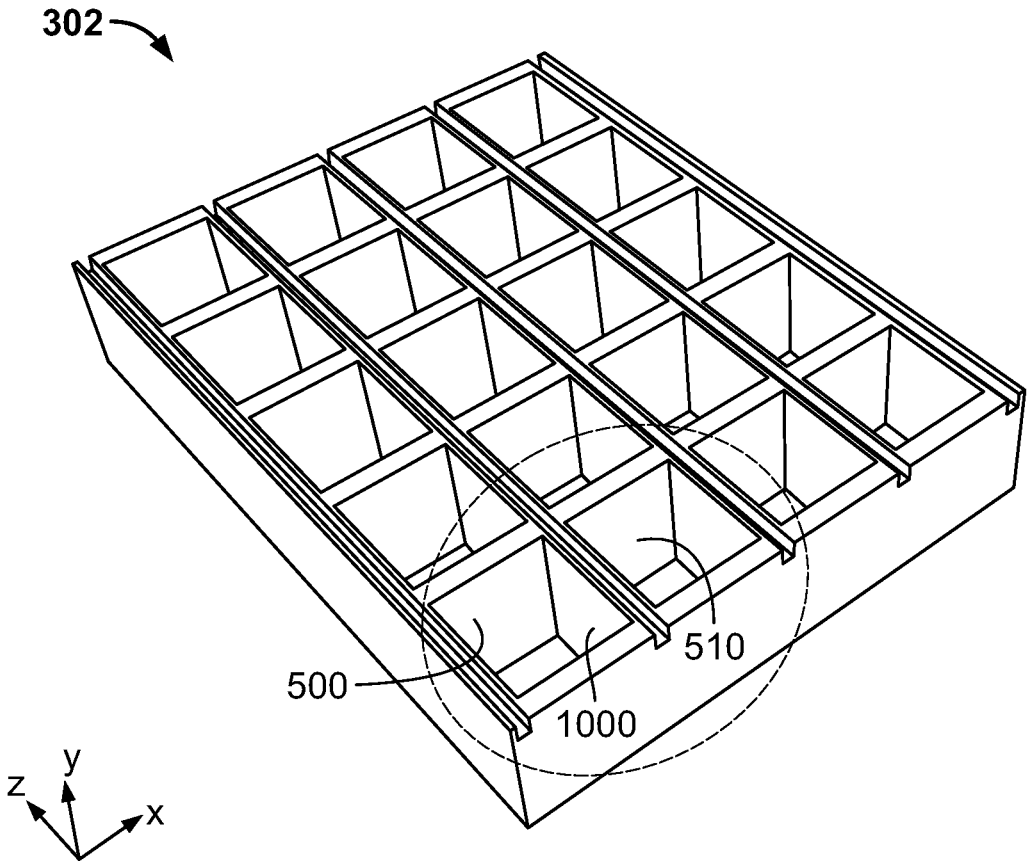
FIG. 10 illustrates an example first anti-scatter structure for an anti-scatter collimator.
Figure 11:
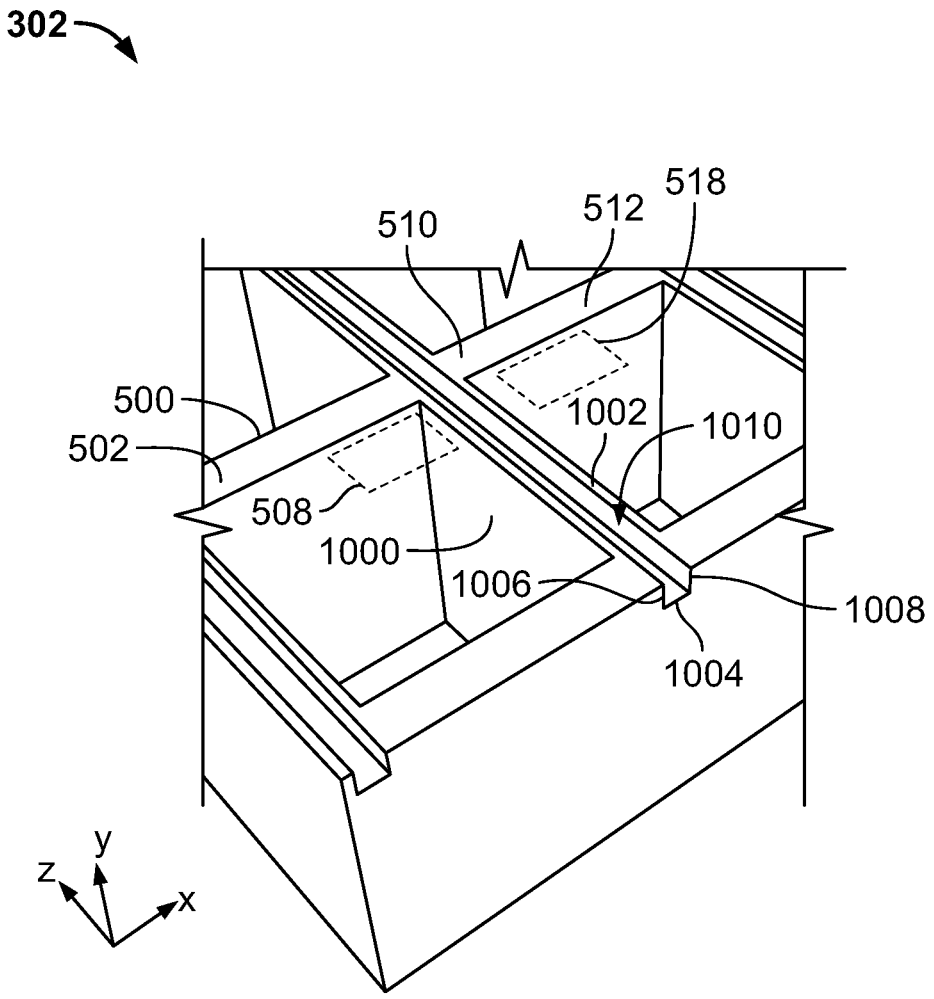
FIG. 11 illustrates an example first anti-scatter structure for an anti-scatter collimator.

Referring to FIGS. 10 and 11, a second example of the first anti-scatter structure 302 is illustrated. In the example, the first anti-scatter structure 302 comprises a support member 1000. The support member 1000 may be similar in some respects to the support member 560 illustrated with respect to FIGS. 5 to 9. For example, the support member 1000 can extend in a similar direction as the support member 560, be located at a similar location as the support member 560, function similarly to the support member 560, etc.

In an example, the support member 1000 can comprise a top support surface 1002 and a bottom support surface 1004. The top support surface 1002 and the bottom support surface 1004 can extend substantially parallel to each other along a length of the support member 1000. For example, the top support surface 1002 and the bottom support surface 1004 can extend along an entire length of the support member 1000 between opposing ends of the support member 1000. The top support surface 1002 can be in closer proximity to the first layer 300 than the bottom support surface 1004.

In an example, the support member 1000 comprises a first sidewall 1006 and a second sidewall 1008 that extend between the top support surface 1002 and the bottom support surface 1004. The first sidewall 1006 and the second sidewall 1008 can extend substantially parallel to each other and substantially perpendicular to the top support surface 1002 and the bottom support surface 1004. The first sidewall 1006 and the second sidewall 1008 can be spaced apart from each other to define a groove 1010. In an example, the groove 1010 can extend along the length of the support member 1000. The top support surface 1002 may be coplanar with the first plane 508 of the first protruding member 500 and the second plane 518 of the second protruding member 510. In an example, the first protruding member 500 and the second protruding member 510 may be spaced apart to define a portion of the groove 1010. In an example, the support member 1000 can have a thickness that is between about 150 μm to about 210 μm, or about 180 μm. In such an example, the groove 1010 can have a thickness that is about 100 μm, while the first sidewall 1006 and/or the second sidewall 1008 can have thickness that are each about 40 μm.

Despite relatively large inertial forces exerted upon the anti-scatter collimator 200 during operation, the septa of the second anti-scatter structure 303 can be maintained in place with reduced vibration and motion. For example, the first and second retaining members can contact the septa to maintain a position of the septa in place relative to the first layer 300 and the first anti-scatter structure 302. In addition, the first anti-scatter structure 302 can be oriented to cover gaps located between scintillators. These gaps may be filled with a reflective material that may be susceptible to damage by radiation. As such, by attenuating radiation that would otherwise impinge upon the reflective material, the first anti-scatter structure 302 can limit damage caused to the reflective material.

It can be appreciated that "example" and/or "exemplary" are used herein to mean serving as an example, instance, or illustration. Any aspect, design, etc. described herein as "example" and/or "exemplary" is not necessarily to be construed as advantageous over other aspects, designs, etc. Rather, use of these terms is intended to present concepts in a concrete fashion. As used in this disclosure, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this disclosure and the appended claims can generally be construed to mean "one or more" unless specified otherwise or clear from context to be directed to a singular form. Also, at least one of A and B or the like generally means A or B or both A and B.

Although the disclosure has been shown and described with respect to one or more implementations, equivalent alterations and modifications will occur to others skilled in the art based upon a reading and understanding of this specification and the annexed drawings. The disclosure includes all such modifications and alterations and is limited only by the scope of the following claims. In particular regard to the various functions performed by the above described components (e.g., elements, resources, etc.), the terms used to describe such components are intended to correspond, unless otherwise indicated, to any component that performs the specified function of the described component (e.g., that is functionally equivalent), even though not structurally equivalent to the disclosed structure, which performs the function in the herein illustrated example implementations of the disclosure. Similarly, illustrated ordering(s) of acts is not meant to be limiting, such that different orderings comprising the same of different (e.g., numbers) of acts are intended to fall within the scope of the instant disclosure. In addition, while a particular feature of the disclosure can have been disclosed with respect to only one of several implementations, such feature can be combined with one or more other features of the other implementations as can be desired and advantageous for any given or particular application. Furthermore, to the extent that the terms "includes," "having," "has," "with," or variants thereof are used in either the detailed description or the claims, such terms are intended to be inclusive in a manner similar to the term "comprising."

What is claimed is:

1. An anti-scatter collimator, comprising:

a first anti-scatter structure defining a retaining member comprising:

a first protruding member having a top surface defining a first plane;

a second protruding member having a second top surface defining a second plane, the second protruding member spaced apart from the first protruding member to define a groove; and a support member extending between the first protruding member and the second protruding member, wherein:

the support member defines a bottom surface of the groove, and the bottom surface of the support member is spaced a distance apart from the first plane and the second plane; and a second anti-scatter structure comprising a septum disposed within the groove, wherein the first protruding member, the second protruding member, and the support member maintain a position of the septum relative to the first anti-scatter structure.

2. The anti-scatter collimator of claim 1, wherein:

the first anti-scatter structure has a second attenuation coefficient; and the septum has a third attenuation coefficient that is substantially similar to the second attenuation coefficient.

3. The anti-scatter collimator of claim 1, comprising a first layer defining a first retaining member at a first surface of the first layer, wherein the first layer has a first attenuation coefficient.

4. The anti-scatter collimator of claim 3, wherein:

the first anti-scatter structure has a second attenuation coefficient, the septum has a third attenuation coefficient, and the first attenuation coefficient is less than the second attenuation coefficient and the third attenuation coefficient.

5. The anti-scatter collimator of claim 1, wherein the first protruding member and the support member at least partially define an opening that passes through the first anti-scatter structure between a first side and a second side of the first anti-scatter structure.

6. The anti-scatter collimator of claim 1, wherein the support member defines a top support surface that is co-planar with the first plane of the first protruding member and the second plane of the second protruding member.

7. The anti-scatter collimator of claim 6, wherein the top support surface and the bottom surface of the support member extend along a length of the support member.

8. The anti-scatter collimator of claim 1, wherein the septum is in contact with the bottom surface of the support member, the septum extending substantially parallel to the support member and substantially perpendicular to the first protruding member and the second protruding member.

9. An anti-scatter collimator, comprising:

a first anti-scatter structure defining a retaining member comprising:

a first protruding member;

a second protruding member spaced apart from the first protruding member to define a groove; and a support member extending between the first protruding member and the second protruding member, wherein the support member defines a bottom surface of the groove, wherein the first protruding member and the support member at least partially define an opening that passes through the first anti-scatter structure between a first side and a second side of the first anti-scatter structure; and a second anti-scatter structure comprising a septum disposed within the groove, wherein the first protruding member, the second protruding member, and the support member maintain a position of the septum relative to the first anti-scatter structure.

10. The anti-scatter collimator of claim 9, comprising a second support member extending substantially parallel to and spaced apart from the support member.

11. The anti-scatter collimator of claim 10, comprising a third protruding member extending substantially parallel to and spaced apart from the first protruding member, wherein the first protruding member, the third protruding member, the support member, and the second support member define the opening.

12. The anti-scatter collimator of claim 11, comprising a fourth protruding member extending substantially parallel to and spaced apart from the second protruding member, the fourth protruding member spaced apart from the third protruding member to define a second groove.

13. The anti-scatter collimator of claim 12, wherein the support member defines a bottom surface of the second groove, the septum disposed within the second groove.

14. The anti-scatter collimator of claim 9, wherein:

the septum has a septum thickness;

the groove has a groove thickness between the first protruding member and the second protruding member; and wherein the septum thickness is less than or equal to the groove thickness.

15. The anti-scatter collimator of claim 14, wherein the support member has a support member thickness that is greater than the septum thickness and the groove thickness.

16. The anti-scatter collimator of claim 9, wherein the septum and the support member are co-planar.

17. An anti-scatter collimator, comprising:

a first layer defining a first retaining member at a first surface of the first layer, wherein the first layer has a first attenuation coefficient, a first anti-scatter structure defining a second retaining member at a first surface of the first anti-scatter structure, wherein:

the first surface of the first anti-scatter structure faces the first surface of the first layer, and the first anti-scatter structure has a second attenuation coefficient that is greater than the first attenuation coefficient; and a second anti-scatter structure comprising a septum disposed between the first layer and the first anti-scatter structure and physically contacting the first retaining member and the second retaining member, wherein:

the first retaining member and the second retaining member maintain a position of the septum relative to the first layer and the first anti-scatter structure, and the septum has a third attenuation coefficient that is greater than the first attenuation coefficient.

18. The anti-scatter collimator of claim 17, wherein the third attenuation coefficient is substantially similar to the second attenuation coefficient.

19. The anti-scatter collimator of claim 17, wherein the second retaining member defines a groove within which the septum is disposed.

20. The anti-scatter collimator of claim 17, wherein the first anti-scatter structure defines at least one opening that passes through the first anti-scatter structure between a first side and a second side of the first anti-scatter structure.

* * * * *